US005617590A

United States Patent [19]

Gastesi

[11] Patent Number: 5,617,590

[45] Date of Patent: Apr. 8, 1997

[54] FLUSH TOILET EXHAUST FIXTURE

[76] Inventor: Ignacio Gastesi, Rrt. 1, Box 591 Y, Scottsville, Va. 24590

[21] Appl. No.: 418,562

[22] Filed: Apr. 10, 1995

[51] Int. Cl.[6] ..... E03D 9/05

[52] U.S. Cl. ..... 4/213

[58] Field of Search ..... 4/213, 216

[56] References Cited

U.S. PATENT DOCUMENTS

| | | | |
|---|---|---|---|
| 4,153,956 | 5/1979 | Fischer et al. | 4/213 |
| 5,054,130 | 10/1991 | Wilson | 4/213 |
| 5,321,856 | 6/1994 | Gastesi | 4/216 X |

*Primary Examiner*—Charles E. Phillips

[57] ABSTRACT

An exhaust fixture adapted to be connected to a toilet, the toilet having a bowl, a water tank having a normal amount of water therein and an upper, peripheral edge, an overflow pipe located within the tank, and a lid adapted to fit about the peripheral edge of the tank; the exhaust fixture comprising spacers disposed between the lid and the tank creating a gap for the passage of air there between, a flexible strip, the flexible strip being a closed loop with a perimeter smaller then the perimeter of the upper, peripheral edge of the tank, the flexible strip being positioned around the tank and the lid sealing the gap and forming a substantially air-tight band there between, the flexible strip having air flow passages for allowing air communication with the tank interior and a hose connector having an inlet for connecting and allowing air communication with the air flow passages of the flexible strip and an outlet, the exhaust fixture further including a blower connected to the outlet for the withdrawal of gases from air space above the normal water level in the tank.

3 Claims, 5 Drawing Sheets

FLUSH TOILET EXHAUST FIXTURE

FIELD OF THE INVENTION

This invention relates to systems that ventilate a toilet bowl by extracting air from the bowl through the flush tank and out to a remote point, and more particularly to a simple device adapted for easy mounting on a large variety of existing flush tank designs.

BACKGROUND OF THE INVENTION

Ventilating water closets by driving air from the bowl through the flush rim has long been recognized as a very efficient method for odor removal but are still not coming to a wide spread use. Some systems which withdrawal this air from the standpipe in a toilet tank and above the level of water in the water tank and are adapted for installation on existing toilets are disclosed in U.S. Pat. Nos. 3,703,010, 3,763,505, 4,165,544, 4,232,406, 4,582,250, 5,029,346, and 5,321,856. The systems disclosed in U.S. Pat. Nos. 4,044, 408, and 5,029,346 resolve the problems of water vapor intrusion. Some systems which resolve the problem of undesirable suction when the toilet is flushed are disclosed in U.S. Pat. Nos. 3703010, 4165544, 4582250, and 5029346.

The methods disclosed in the patents have the major disadvantage of not being adapted for easy mounting and that a particular element is only adapted to a particular water tank design.

The method disclosed in the U.S. Pat. No. 5,321,856 has the disadvantage of poor sealing when the water tank upper edge presents irregularities.

SUMMARY OF THE INVENTION

It is an object of the present invention to provide an inexpensive and easy to manufacture toilet odor removing apparatus that mounts easily on a large variety of existing toilet designs and toilet installations and seals the lid to the water tank adequately when the water tank upper edge presents irregularities.

It is still a further object of the present invention to provide an apparatus that permits existing bathroom ventilation systems to be connected directly to the toilet.

It is still a further object of the present invention to provide an apparatus for toilet odor removal that is not located on the toilet bowl and, consequently, is not required to be periodically cleaned and does not interfere with the cleaning operations.

The instant invention relates to systems for venting odors from toilets having a bowl with a plurality of openings disposed about its rim, a water tank with a overflow pipe on air communication with the air space above the level of the water in the water tank and a lid for the water tank. The device is an exhaust fixture that can be installed on a wide variety of toilet designs. It is a wide strip wrapped around the water tank and the water tank lid with a hose connector attached to it, making the interior of the water tank air tight.

In a preferred embodiment the device is comprised of:

Spacers mounted over the upper, peripheral edge of the water tank to support the lid and to create a gap in between the water tank and the lid increasing the air passage in between them.

A sealing means being a flexible elastic strip forming a closed loop, rubber band like, with a perimeter smaller than the perimeter of the upper, peripheral edge of the water tank and including at least one opening for the air to pass through the strip and which installation comprises, stretching the loop to wrap the strip around the water tank and it lid adapting its length and shape to their outer perimeters, covering the gap in between and forming a substantially air-tight band around the water tank and the lid.

A hose connector, connected to the sealing means at the strips opening either by press fit or bonded, and in air communication with the air space interior of the water tank and the atmosphere exterior of the water tank.

In a different embodiment the sealing mean may be a tape like strip with out forming a closed loop. After being wrapped around the water tank and the lid the installation is completed by over lapping and bonding the open ends to close the loop.

In another embodiment, the system may include a vent device connected together to the sealing means, allowing the venting of the water tank when it is flushed, The vent device comprises a housing having an opening which is submerged under the normal water level of the water tank any an interior chamber within the housing in fluid communication between the submerged opening and the atmosphere exterior to the water tank.

Other objects features and advantages will become apparent in the following specifications and detailed description of the invention.

DETAILED DESCRIPTION OF THE INVENTION

Figure 1:
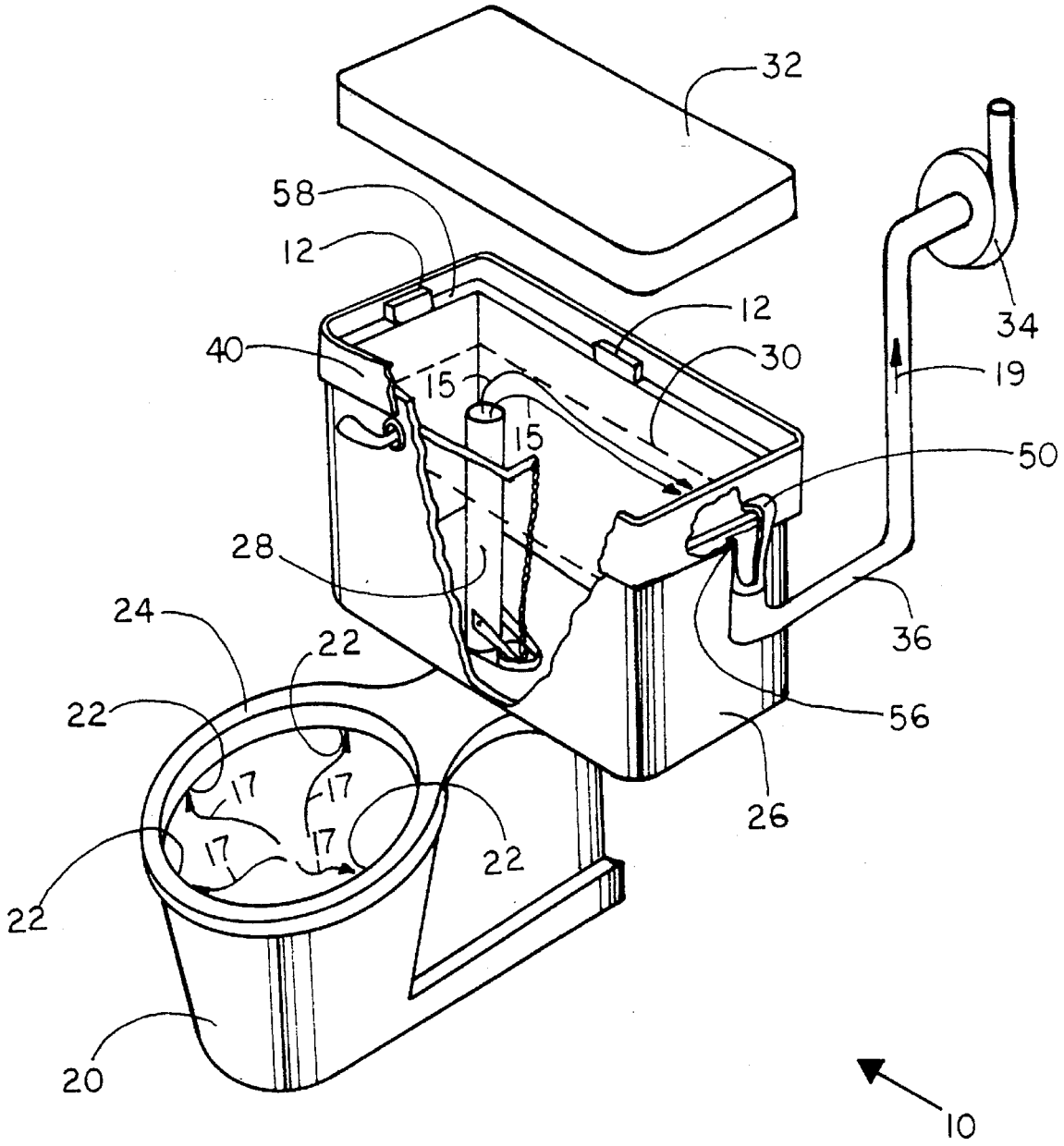
FIG. 1 is a perspective view of the preferred embodiment of the device having the conventional toilet and the invented device broken away, to show the path of the air flow.

FIG. 1 illustrates a preferred embodiment of the present invention.

Number 10 generally designates a conventional toilet that includes a toilet bowl 20 with a plurality of openings 22 disposed about its rim 24. A water tank 26 with a overflow pipe 28 in air communication with the air space above the level of the water 30 in the water tank 26 and the openings 22 disposed on the rim 24 and a lid 32 for the water tank 26.

The spacers 12 raise and support the lid 32 creating a gap in between the water tank 26 and the lid 32. This spacers are either press fit or glued to the upper edge 58 of the water tank 26. The shape, dimensions or position of the spacers 12 are not critical and may be placed to suit the convenience and needs of installation.

The exhaust fixture 40 of the device is positioned outside and around the water tank 26 and the lid 32, to form an air tight band around the gap in between, increasing the efficiency of the blower action.

Generally designated blower 34 connected via the hose 36 to the hose connector 50 of the exhaust fixture 40 of the device, extract air, indicated with arrow 19, from the air space above the level of the water 30, through the opening 56 of the exhaust fixture 40 of the device, and indicated by arrows 15 and consequently from the toilet bowl 20 through the openings 22 disposed in the rim 24 and indicated by arrows 17 via the overflow pipe 28. From blower 34, the extracted air is directed to an area remote from the toilet. Having described the functions of the exhaust fixture 40 of the device, the novel apparatus will now be described.

Figure 2:
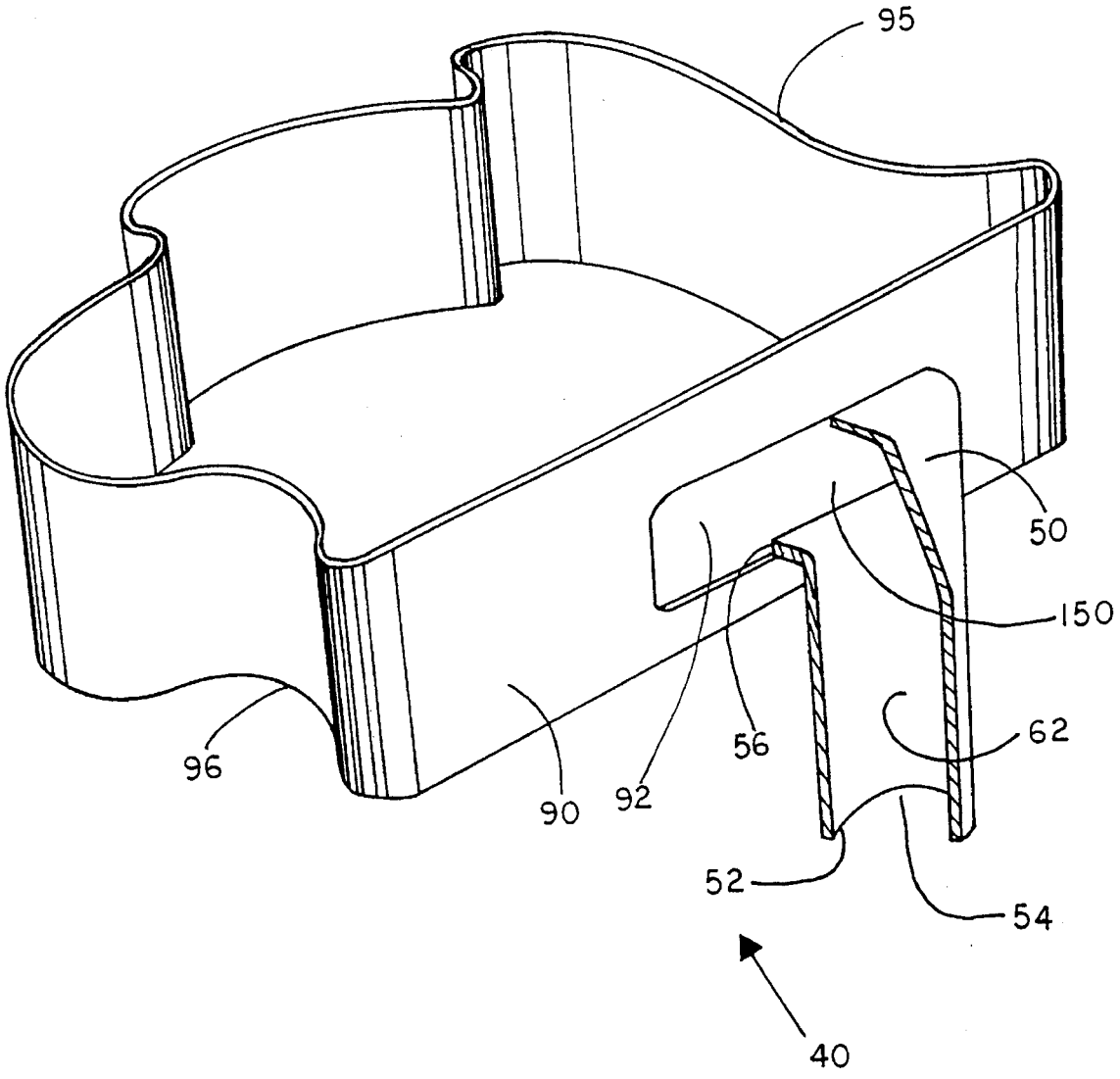
FIG. 2 is a exploded view of the preferred embodiment of the exhaust fixture of the present device.

FIG. 2 designates the preferred embodiment of the exhaust fixture 40 of the device. Apparatus 40 comprise a hose connector 50 and a seal element 90. The hose connector 50 includes an edge 52 having opening 54 and prepare to be coupled to a hollow hose, an edge 56 having opening 150 and prepare to be press fit or bonded to a seal element 90 and a hollow chamber 62 extending from opening 54 to opening 150.

The seal element 90 is a flexible closed loop strip and includes edges 95 and 96 adapted to seal against the water tank and the lid and secure the position of the seal element 90 and having an opening 92 in between edges 95 and 96 where the hose connector 50 is connected.

Figure 3:
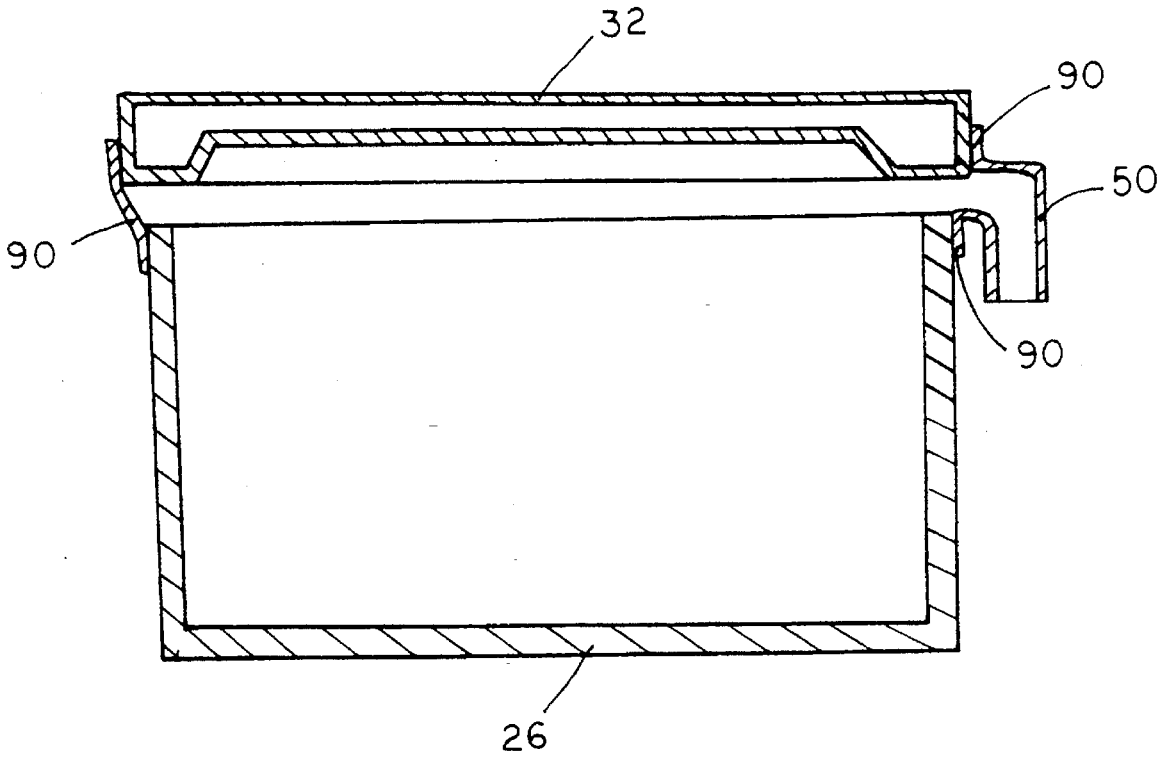
FIG. 3 is a cross section of the water tank, the lid and the exhaust fixture of the present device.

FIG. 3 shows the relative position of the hose connector 50 and the sealing strip 90 with respect the water tank 26 and the lid 32.

Figure 4:
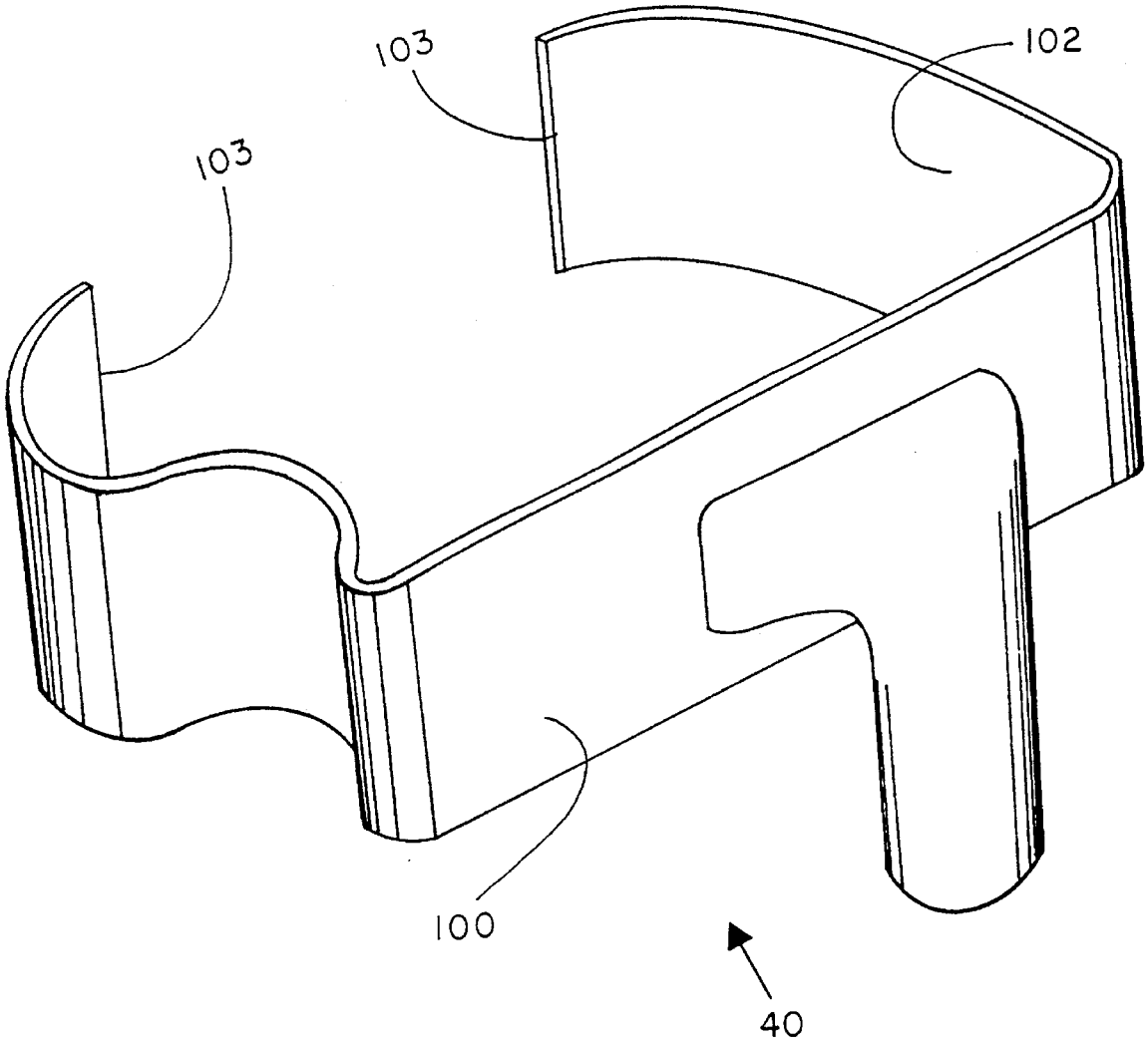
FIG. 4 is a exploded view of another embodiment of the exhaust fixture of the present device.

FIG. 4 shows another embodiment of the apparatus 40. A seal element 100 with an adhesive interior face 102 and with first and second ends 103.

Figure 5:
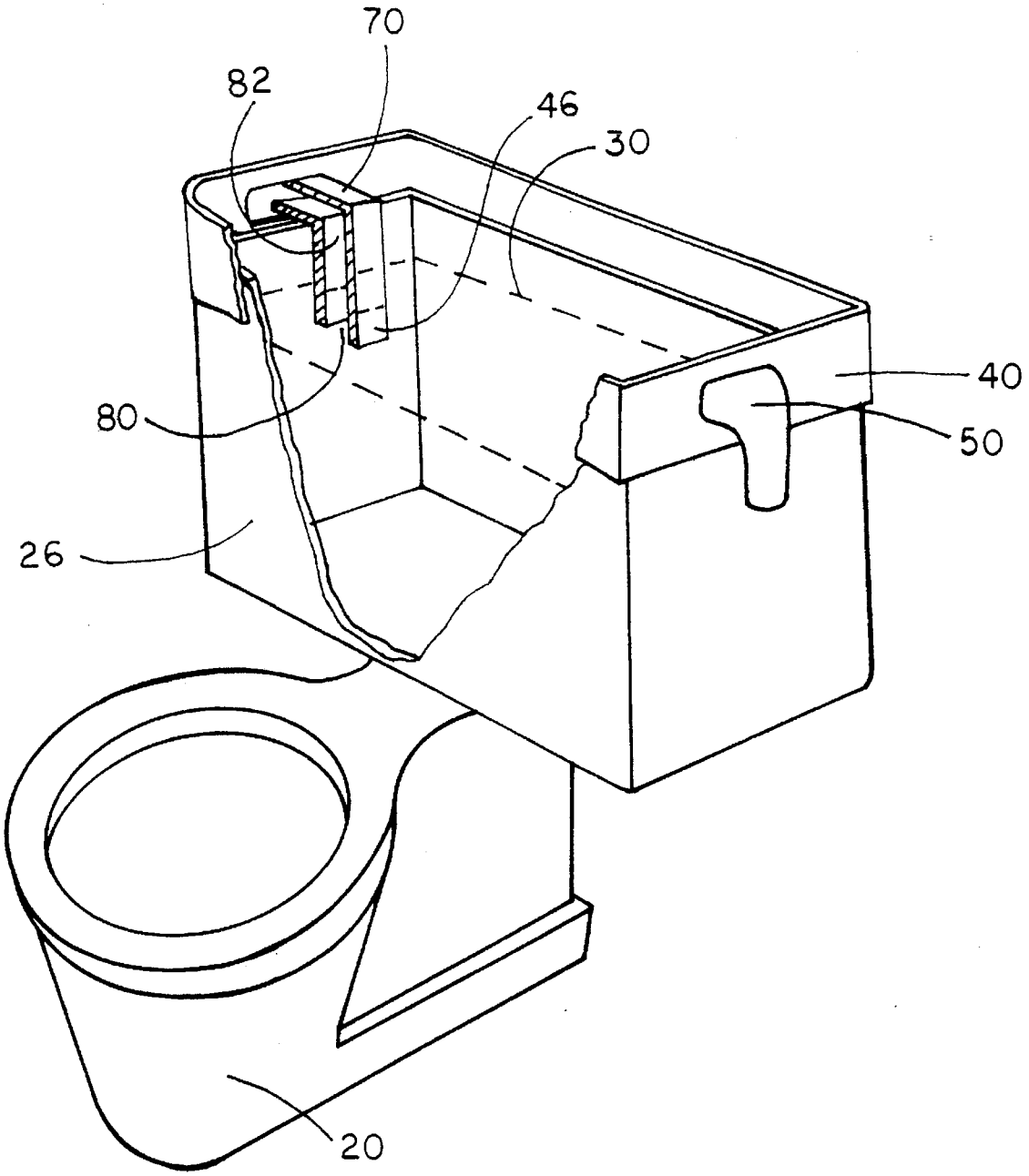
FIG. 5 is a exploded view of another embodiment of the exhaust fixture of the present device including a vent device.

FIG. 5 shows another embodiment of the apparatus 40. A vent device 70 is now included on the exhaust fixture 40 of the device and eliminates any vacuum and thereby any restriction of the normal flow of water from the water tank 26 to the toilet bowl 20 during the flushing operation. As the water level 30 in the water tank 26 drops, the opening 80 of the submerged end 46 of the vent device 70 becomes uncovered, so air can be drawn from the exterior of the water tank 26 via the hollow chamber 82 of the vent device 70 to the air space above the water level 30 on the water tank 26.

The placement of the hose connector 50 and the vent device 70 are not critical and may be placed to suit the convenience and needs of installation.

The hose connector, the seal element, and the vent device can be made out of resilient materials like plastic or rubber and with soft surfaces where the elements come in contact with the tank and the lid, for a better seal.

I claim:

1. An exhaust fixture adapted to be connected to a toilet, said toilet having a bowl with a rim, a water tank having a normal amount of water therein and an upper peripheral edge, an overflow pipe located within said water tank, and a lid spaced from an upper peripheral edge of said tank; the exhaust fixture comprising a flexible strip, said flexible strip being a closed loop with a perimeter smaller than the perimeter of said upper, peripheral edge of said tank, said flexible strip adapted to be configured around said water tank and said lid, said flexible strip having sealing means for sealing said flexible strip about said water tank and said lid forming a substantially air-tight band there between, said flexible strip having an air vent allowing air communication between the tank interior and the tank exterior and a hose connector having an inlet for connecting and for allowing air communication with said tank interior and an outlet, said hose connector further including an air vent for allowing air communication in between said inlet and said outlet, and blower means connected to said outlet for the withdrawal of gases from air space above said normal water level in said tank, said overflow pipe and consequently from said bowl through said exhaust fixture and said blower means to an area remote from the toilet.

2. The exhaust fixture of claim 1 further including spacer means disposed between said lid and said tank creating a gap for the passage of air there between.

3. The exhaust fixture of claim 1 further having a venting means comprising a housing allowing air communication through said flexible strip, said housing having an exterior edge having an opening thereon, said exterior edge located exterior to said tank after installation of said fixture and said opening being in fluid connection with air exterior to said tank, said housing further having an interior edge having an opening thereon, said interior edge located within said tank, said interior opening adapted to be disposed below said normal water level in said tank, said venting means further including a hollow chamber therein in fluid communication with said openings in said exterior and interior edges, wherein after flushing when the water level in the tank has gone below said normal water level and said interior opening said exhaust fixture withdraws gases from said tank interior and the air exterior to said tank.

* * * * *